United States Patent [19]

Greenhawk, Sr.

[11] 4,197,603

[45] Apr. 15, 1980

[54] BED-ASSOCIATED BACK-SUPPORT MEANS

[76] Inventor: Ronald E. Greenhawk, Sr., 107 Marsh Rd., Wilmington, Del. 19809

[21] Appl. No.: 934,706

[22] Filed: Aug. 21, 1978

[51] Int. Cl.[2] ..... A47C 21/00

[52] U.S. Cl. ..... 5/431; 5/513

[58] Field of Search ..... 5/327, 329, 330, 334 R, 5/337, 338, 340, 354, 355, 361 B; 66/202; 2/93, 97, 69.5, 115; 57/140 BS

[56] References Cited

U.S. PATENT DOCUMENTS

| | | | |
|---|---|---|---|
| 2,298,218 | 10/1942 | Madson | 5/337 |
| 2,641,779 | 6/1953 | Gill | 5/339 |
| 3,608,961 | 9/1971 | Von Heck | 5/361 R |
| 3,800,340 | 4/1974 | Valentine | 5/334 R |
| 3,924,284 | 12/1975 | Nelson | 5/284 |
| 3,938,205 | 2/1976 | Spann | 5/327 B |

FOREIGN PATENT DOCUMENTS

| | | | |
|---|---|---|---|
| 896203 | 3/1972 | Canada | 5/329 R |

OTHER PUBLICATIONS

Reisfeld, "Warp Knit Eng.," N.Y., Chap. 6, p. 82.

Knitting Ency., Pub. by "Nat. Knitted Outerwear Assoc," p. 210.

*Primary Examiner*—Casmir A. Nunberg

*Attorney, Agent, or Firm*—Peter J. Georges

[57] ABSTRACT

A back support means which may be detachably positioned on a mattress comprising a bottom sheet having a width to cover the central portion of a mattress and extending across the width of said mattress, which bottom sheet along with a top sheet form an open-ended pillow receptacle substantially extending the width of said bottom sheet. Within the open-ended pillow receptacle is placed a pillow of a size substantially conforming to the interior of the open-ended receptacle. The pillow is filled with shredded polymeric foam, preferably a rigid or semi-rigid shredded polystyrene foam.

8 Claims, 5 Drawing Figures

BED-ASSOCIATED BACK-SUPPORT MEANS

BACKGROUND OF THE INVENTION

1. Field of the Invention

The present invention is directed to a back-support means which is detachably attached to a mattress. The back support means is constructed utilizing an open-ended pillow receptacle and a shredded polystyrene foamed pillow which is inserted within the receptacle.

2. Description of the Prior Art

Combined sheets and pillowcases are well known in the art and are disclosed in U.S. Pat. Nos. 3,800,340, 3,148,388, 2,386,031 and 2,462,780. However, it has never heretofore been recognized that a very effective back support means could be produced by positioning an elongated open-ended pillow receptacle at the central portion of the mattress with the elongated side of said pillow receptacle running lengthwise on the mattress and by then placing in the receptacle a pillow filled with rigid polymeric foam.

SUMMARY OF THE INVENTION

This invention relates to a back support means adapted for detachable positioning on a mattress. The back support means is comprised of a bottom sheet which is wide enough to cover the central portion of a mattress, and has a length substantially extending the width of said mattress. The bottom sheet has means for detachable affixation to said mattress. An open-ended pillow receptacle is formed by a top sheet having a length substantially extending the width of the bottom sheet, which top sheet is attached to the bottom sheet along the length of the top sheet proximate the edges thereof. A pillow of a size substantially conforming to the interior of the open-ended pillow receptacle comprising a pillow casing filled with shredded polymeric foam is inserted within the pillow receptacle and provides back support.

The pillow casing, top sheet and bottom sheet may each be made of an insulative type cloth material, and preferably the top sheet and pillow casing are made of insulative material. A preferred insulative type cloth material is thermal suede which has a content of 50% polyester and 50% cotton.

The means for detachably affixing the bottom sheet to the mattress comprises an extension of the length of the bottom sheet whereby the bottom sheet overlays each of the two lengthwise edges of the mattress and extends beneath the mattress. A draw string extending beneath said mattress and connecting the ends of the bottom sheets may also be used to secure the bottom sheet to the mattress.

The shredded polymeric foam material is comprised of particles having irregular surfaces and its use is essential. Round polymeric beads are not satisfactory. By using shredded foam material, a material which has irregular surfaces, the pillow has a tendency to retain the configuration caused by intentional body movement and thereby provides support for the back. The round polymeric beads often used as filler move too readily as a result of involuntary or slight body movement and this constant fluidity is unsatisfactory to provide adequate support. The foam material used in this invention may be of the rigid or semi-rigid type. Polystyrene is the preferred material for the shredded foam.

The pillow receptacle is preferably formed by attaching a top sheet of about 26 inches in width and 30 inches in length along the lengthwise edges thereof to said bottom sheet, said edges being attached to said bottom sheet a distance of about 16 inches apart and said pillow casing being of triangular cross-section, said triangle measuring about twelve inches by about twelve inches by about 15 inches, the length of said pillow casing being substantially filled with shredded polystyrene foam.

DETAILED DESCRIPTION OF THE DRAWINGS

Figure 1:
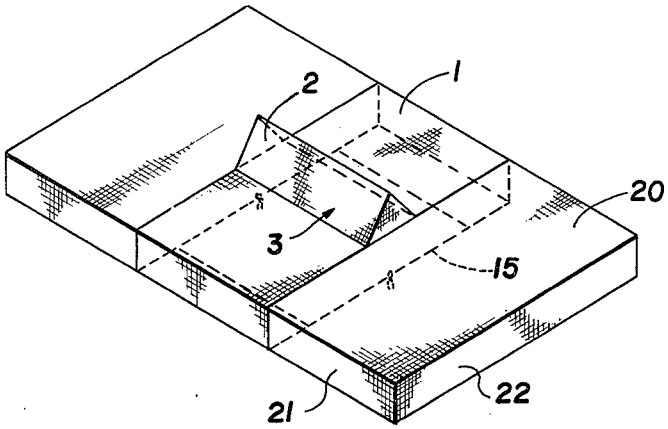
FIG. 1 is a perspective view of the back support means positioned on a mattress.
Figure 2:
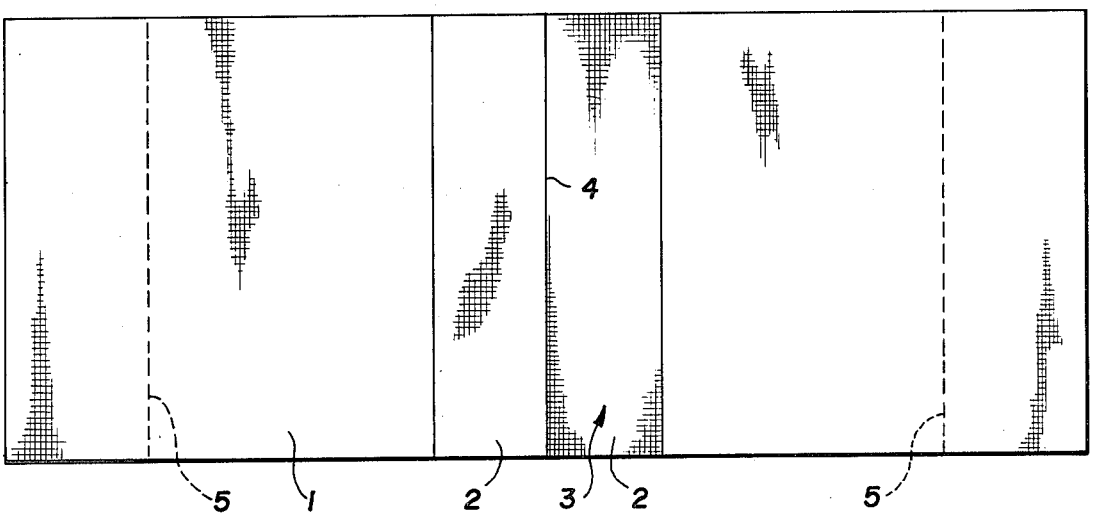
FIG. 2 is a top plan view showing the combination of top and bottom sheet which form the pillow retaining receptacle.
Figure 3:
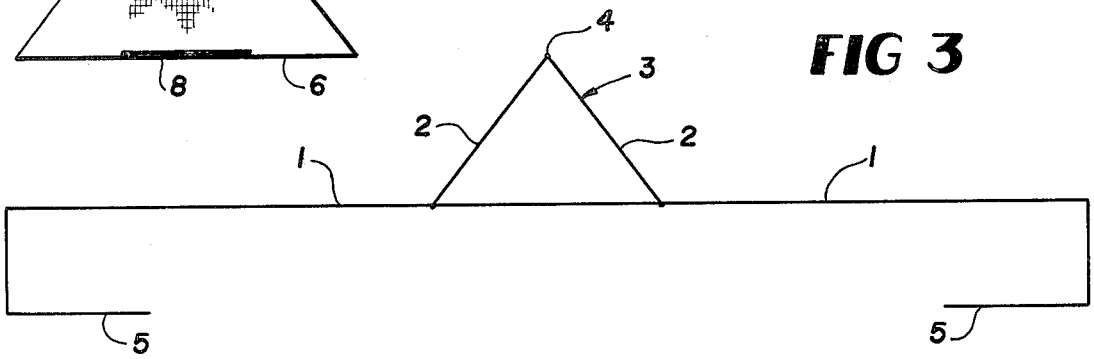
FIG. 3 is an end view showing the combination of top and bottom sheet which form the pillow retaining receptacle.

Referring to FIG. 1, the pillow receptacle 3 with pillow 10 disposed therein is shown in place upon mattress 20. Pillow receptacle 3 is formed by bottom sheet 1 and top sheet 2. The means of attachment to the mattress comprises an extension 5 of the bottom sheet 1 which overlaps the two lengthwise edges 21 of mattress 20 and extends beneath the mattress. As best illustrated in FIGS. 2 and 3 extension 5 extends beneath the mattress a distance such that the weight of mattress and occupant retains the back support means in place, generally about 10 inches or so is adequate. A drawstring 20 may optionally be used to retain the bottom sheet 1 in place and as illustrated in FIG. 1, the drawstring may be combined with the bottom sheet extension 5 for this purpose.

The pillow receptacle as best illustrated in FIG. 3 is formed by top sheet 2 and bottom sheet 1. The pillow receptacle is open-ended and must be open at least at one end in order to insert the pillow. In one embodiment of the invention the top sheet 1 is about 26 inches in width and 30 inches in length. The top sheet 2 may be a single sheet or made up of two halves connected along their lengthwise edges by a seam 4. The pillow receptacle 3 is formed by attaching the top sheet 2 along the lengthwise edges thereof to the bottom sheet 1, which is about 30 inches wide, with the lengthwise edges of the top sheet being attached to the bottom sheet a distance of about 16 inches apart.

Figure 4:
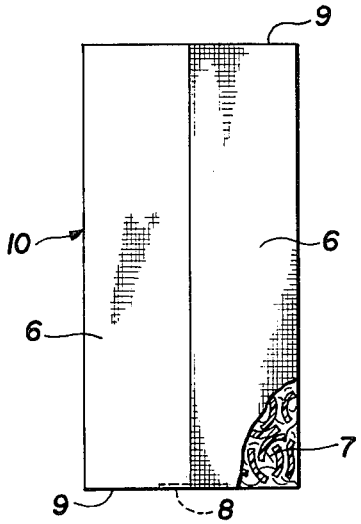
FIG. 4 is the top plan view of the pillow casing containing shredded polymeric foam.
Figure 5:
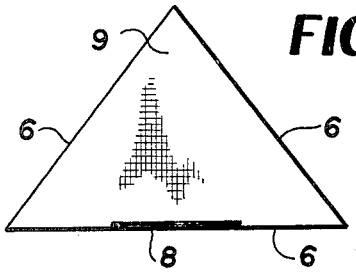
FIG. 5 is the end view of the filled pillow casing containing shredded polymeric foam.

In FIG. 4 and FIG. 5, the pillow 10 is shown. Pillow 10 is made up of three elongated side panels 6. The panels with zipper 8 is about 15 inches in width, the other two panels are 12 inches in width. The resultant pillow 10 has a cross section which is triangular measuring about 12 inches on two sides and 15 inches on the third side. The panels may be separate and connected at their lengthwise edges or one continuing piece of fabric. The zipper 8 illustrated in FIG. 5 is located along one of the side panels 9; however, any other location is satisfactory.

As shown in FIG. 4, the pillow is filled with rigid shredded polymeric foam such as polystyrene and such filling may be effected through zipper 8.

The top sheet 2 which contacts the body is constructed of an insulative type cloth whereby body heat is not withdrawn. The pillow cover may also be made of the same material to enhance this characteristic of the overall back support arrangement. The polymeric foam may be selected from any number of polymeric materials. However, it is essential that the foam be of shredded type; that is, having an irregular surface and that the foam be of the rigid type; that is, the foam can not be a soft foam which is elastic and easily compressible, such as ordinarily found in foam pillows. Shredded polystyrene foam is commercially available and is well suited as pillow filling. The shredded polymeric foam content may be increased or decreased as necessary to obtain the most comfortable degree of support.

It is not intended to limit the invention to the details heretofor recited, the invention being defined in the claims which follow.

I claim:

1. A back support means adapted for detachable positioning on a mattress comprising:

(a) a bottom sheet having a width to cover the central portion of a mattress and a length substantially extending the width of said mattress, said bottom sheet having means for detachable affixation to said mattress;

(b) an open-ended pillow receptacle formed by a top sheet having a length substantially extending the width of said bottom sheet, said top sheet being attached to said bottom sheet along the length of said top sheet proximate the edges thereof; and (c) a pillow of a size substantially conforming to the interior of said open-ended pillow receptacle comprised of a pillow casing filled with rigid shredded polymeric foam, said shredded polymeric foam being comprised of particles having irregular surfaces whereby the pillow retains the configuration caused by intentional body movement.

2. The back support means of claim 1 further characterized in that the top sheet is made of an insulative type cloth material.

3. The back support means of claim 1 further characterized in that said means for detachable affixation comprises an extension of the length of said bottom sheet whereby said sheet overlaps each of the two lengthwise edges of said mattress and extends beneath said mattress.

4. The back support means of claim 1 further characterized in that the means for detachable affixation comprises a draw string extending beneath said mattress and connecting the ends of the bottom sheet.

5. The back support means of claim 1 further characterized in that said shredded polymeric foam is polystyrene.

6. The back support means of claim 2 further characterized in that the insulative type cloth material is thermal suede having a content of 50% polyester and 50% cotton.

7. The back support means of claim 1 further characterized in that said pillow receptacle is formed by attaching a top sheet of about 26 inches in width and 30 inches in length along the lengthwise edges thereof to said bottom sheet, said edges being attached to said bottom sheet a distance of about 16 inches apart and said pillow casing is of triangular cross-section, said triangle measuring about twelve inches by about twelve inches by about 15 inches, the length of said pillow casing being substantially filled with shredded polystyrene foam.

8. The back support member of claim 7 further characterized in that the pillow casing is made of an insulative type cloth material.

* * * * *